United States Patent [19]

Fraioli

[11] 4,156,330

[45] * May 29, 1979

[54] DOUBLE WALL FABRIC PANEL UNIT

[75] Inventor: Donato M. Fraioli, Mamaroneck, N.Y.

[73] Assignee: Air Tech Industries, Inc., Clifton, N.J.

[ * ] Notice: The portion of the term of this patent subsequent to Jan. 3, 1995, has been disclaimed.

[21] Appl. No.: 865,123

[22] Filed: Dec. 28, 1977

Related U.S. Application Data

[63] Continuation of Ser. No. 696,635, Jun. 16, 1976, Pat. No. 4,065,889.

[51] Int. Cl.[2] ..... E04B 1/34

[52] U.S. Cl. ..... 52/2; 428/178

[58] Field of Search ..... 52/2, 63; 5/349; 47/17; 428/178

[56] References Cited

U.S. PATENT DOCUMENTS

| | | | |
|---|---|---|---|
| 2,411,316 | 11/1946 | Capita | 52/2 |
| 2,656,844 | 10/1953 | Kreuzer | 52/2 |
| 2,853,720 | 9/1958 | Friedlander | 52/349 |
| 3,249,682 | 5/1966 | Laing | 52/2 |
| 3,339,309 | 9/1967 | Stone | 5/349 |
| 3,357,142 | 12/1967 | Farrer | 52/2 |
| 3,548,904 | 12/1970 | Mackell | 52/2 |
| 3,742,657 | 7/1973 | Price | 52/2 |
| 3,836,417 | 9/1974 | Yaeger | 52/86 |
| 3,911,913 | 10/1975 | June | 52/2 |
| 3,936,984 | 2/1976 | Yando | 52/2 |
| 3,970,096 | 7/1976 | Nicolai | 135/DIG. 1 |
| 4,024,679 | 5/1977 | Rain | 52/2 |

FOREIGN PATENT DOCUMENTS

| | | | |
|---|---|---|---|
| 2213869 | 10/1973 | Fed. Rep. of Germany | 52/2 |

*Primary Examiner*—Price C. Faw, Jr.
*Assistant Examiner*—H. C. Raduazo
*Attorney, Agent, or Firm*—Darby & Darby

[57] ABSTRACT

A double wall fabric panel unit for use as a wall section in the construction of inflatable buildings comprising an elongated exterior fabric envelope panel having a plastic coating on each side, and an elongated thermal liner panel having side edge strips heat-sealed to the exterior panel. The thermal liner has a foil layer facing the exterior panel and a white plastic layer on the opposite side. The side edge strips are periodically interrupted to provide air passageways to vent air from between the panels when the unit is rolled.

6 Claims, 5 Drawing Figures

Fig. 1
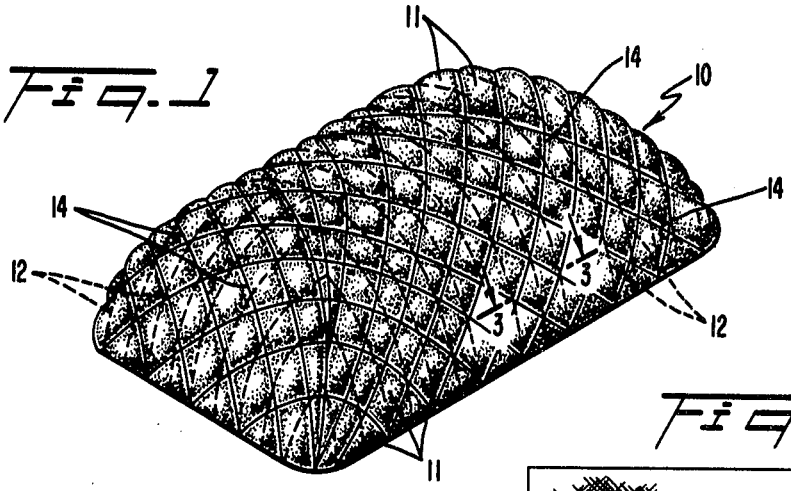
Fig. 2
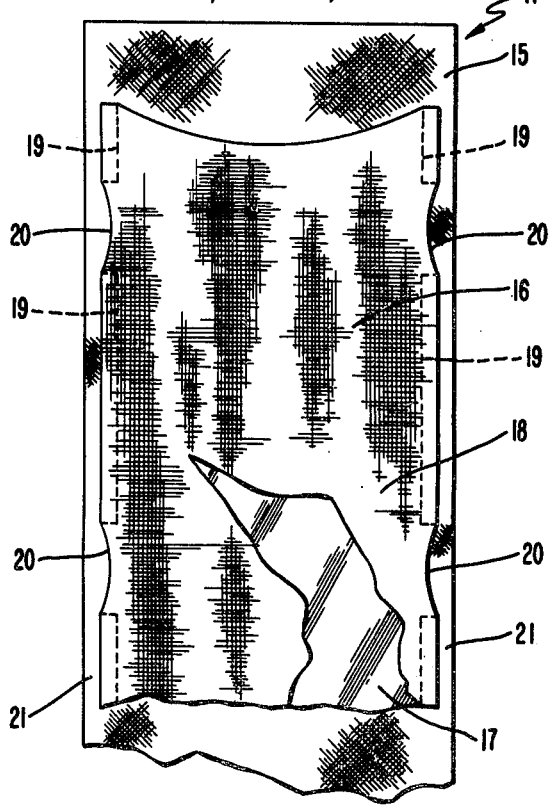
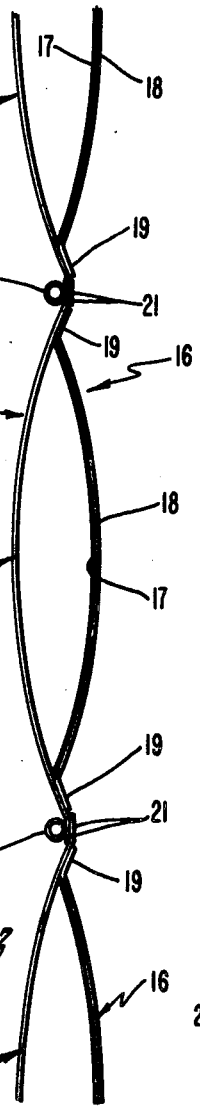
Fig. 3
Fig. 4
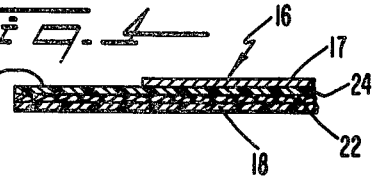
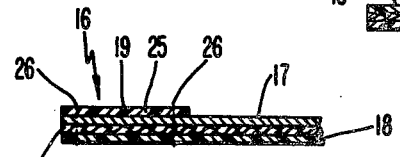
Fig. 5

DOUBLE WALL FABRIC PANEL UNIT

This application is a continuation of my prior copending application Ser. No. 696,635 filed June 16, 1976, which is assigned to the same assignee, and is now U.S. Pat. No. 4,065,889.

BACKGROUND OF THE INVENTION

The present invention relates to fabric buildings supported by pressurized air pumped into the interior of the building, and, more particularly, to such buildings which are provided with arrangements for minimizing the heat flow through the building walls. These fabric buildings are composed of a plastic-coated fabric shell or skin which is anchored and sealed to the ground. Large capacity air blowers are used to pump air into the building to maintain the air pressure within the building somewhat above atmospheric. The blowers replace the air which flows through any perforations in the plastic coating on the fabric, that air which escapes when the doors of the building are opened, and that air which escapes because of imperfect seals at the ground and around doors.

Inflatable buildings of this type are used to enclose recreational facilities for use in the winter time. Swimming pools and tennis courts are two examples of such facilities which are commonly converted for winter use by the erection of an inflatable building. Naturally, such buildings must be heated and this is done by heating the air that is pumped into the building to maintain its interior pressure. Most of these recreational structures are used only in the winter. In the spring, they are deflated, taken apart, and the sections are rolled up for storage.

Attempts have been made in the past to insulate inflated fabric buildings by providing double-wall panels, however, the arrangements used have not been satisfactory. The previously tried double wall units could not be rolled without breaking the inner wall, the construction of the double-wall units was frequently not effective in significantly reducing heat transmission, and the construction of the units increased the rate of air loss from the building, thus increasing the heating requirements.

SUMMARY OF THE INVENTION

It is an object of the present invention to provide an improved insulated fabric panel unit for use in the construction of inflatable buildings.

Another object is to provide such a unit which can be rolled without difficulty of damage to the unit.

The foregoing objects are accomplished by providing a double-wall fabric panel unit which includes a plastic-coated fabric panel and a thermal liner panel having side edge strips attached to the plastic coating on the first panel, the liner panel having a reflective metallic surface facing the first panel and the side edge strips being discontinuous to provide spaced air passageways to vent air from between the panels.

BRIEF DESCRIPTION OF THE DRAWINGS

Preferred embodiments of the invention have been chosen for purposes of illustration and description, and are shown in the accompanying drawings, forming a part of the specification, wherein:

FIG. 1 is a perspective view of an inflatable building constructed of panel units according to the present invention;

FIG. 2 is a view of the interior surface of a panel unit according to the present invention;

FIG. 3 is a sectional view taken along line 3—3 in FIG. 1 showing the construction of the wall building;

FIG. 4 is a sectional view of a thermal liner panel according to the present invention; and FIG. 5 is a sectional view of a modified thermal liner panel according to the present invention.

DESCRIPTION OF THE PREFERRED EMBODIMENTS

Referring now to FIG. 1 of the drawings, there is shown an inflatable building 10 constructed of double-wall fabric panel units 11 built in accordance with the present invention. The panel units on each side of the building are arranged side by side and are joined together along seams 12 shown in the drawing as dashed lines. A network of interconnected steel cables 14 (plastic-coated), shown in the drawing as solid lines, overlies the fabric shell to reduce the tension transmitted to the fabric by the air pressure within the building. In accordance with standard practice, the fabric shell is composed of a number of separable sections (not delineated in the drawings) which are fastened together by lacing or suitable fasteners to allow the sections to be taken apart for storage when the building is taken down.

As shown in FIG. 2, each of the panel units 11 includes an elongated outer panel 15 and an elongated inner panel 16 which is slightly narrower than the outer panel. The outer panel is a strip of fabric (for example, polyester) which has a coating of vinyl plastic on each surface. The panel 16 has a polished aluminum layer 17 on one side and a layer 18 of white vinyl on the other side. The panel 16 is attached to the panel 15 with the aluminum layer 17 facing the panel 15. In FIG. 2, the panel 16 is shown with a portion of the inner layers removed to disclose the layer 17. The side of the panel 16 having the layer 17 is provided with edge strip areas 19 having vinyl plastic surfaces. The panel 16 is secured to the panel 15 by fusing (with heat) the vinyl surface of the areas 19 to the vinyl coating on the panel 15. The strip areas 19 are discontinuous and regularly spaced to provide air vent passageways 20 through which air may escape from between the panels when the sections of the building are rolled for storage. The panel 15 is provided with an edge strip 21 on each side of the panel 16.

As shown in FIG. 3, the edge portions 21 of adjacent panels 15 are overlapped and heat-sealed to fuse the vinyl coatings thereon and thus form a section of an inflatable building.

Referring to FIG. 4, the panel 16 preferably includes a layer of fabric 22 which is covered with the vinyl layer 18 on one side and a second vinyl layer 24 on the other side. The foil layer 17 is bonded to the vinyl layer 24 by a suitable adhesive or bonding agent. The foil layer 17 is shaped so that it covers the vinyl layer 24 except for the edge strip areas 19 where the vinyl is exposed for heat-sealing to the vinyl surface of the panel 15.

FIG. 5 shows a portion of a panel 16 of modified construction. In this embodiment, the fabric layer 22 is covered with vinyl on only one side (by layer 18) and the foil layer 17 is bonded directly to the fabric layer 22 by a suitable bonding agent or adhesive. Vinyl strips 25 are sewn to the panel 16 by stitches 26 to provide the edge strip areas 19 for bonding to the panel 15.

In use, the double-wall fabric panel unit reduces heat transfer through the wall of the building by both convection and radiation. The air space between the panels 15 and 16 reduces the heat transfer by convection. The white vinyl layer 18 and the foil layer 17 reduce heat transfer by radiation. The white layer 18 reflects back into the building any radiant heat emanating from within the building. The polished aluminum foil layer 17 has low emissivity, therefore, when the panel 16 is heated by warm air within the building, little of the heat in the panel is lost by radiation toward the outer wall 15.

During winter operation, the normal heat loss through a single-walled structure is approximately 1.2 BTU/ft$^2$/° F./hour. The double-wall fabric panel unit of the present invention reduces the heat loss to about 0.45 BTU/ft$^2$/° F./hour, thereby reducing fuel costs by approximately 50%.

The present invention also enables inflated buildings to be effectively air-conditioned so that they may be used for sports and like activities during the summer. As the outer wall panels 15 are heated by the sun, the air space between the panels 15 and 16 reduce heat transfer by convection while the foil layer 17 reflects the radiant heat.

It will be seen from the foregoing that the present invention provides an improved insulated fabric panel unit for use in the construction of inflatable buildings, which can be rolled without difficulty or damage to the unit.

What is claimed is:

1. A double-wall fabric panel unit having interior and exterior sides for use as wall sections in the construction of inflatable buildings, comprising, in combination, a first elongated panel of fabric, and an elongated thermal liner panel having an edge strip extending along each side edge thereof attached to the face of said first panel which is in the interior of the building, each of said side edge strips being discontinuous at intervals along the length of said liner panel to provide a plurality of spaced unobstructed air passageways to the atmosphere to vent air from between said panels when said unit is rolled.

2. A panel unit according to claim 1, wherein said face of said first panel includes a plastic material and said side edge strips have plastic surfaces heat-sealed to the plastic material of said face of said first panel.

3. A panel unit according to claim 2, wherein said first panel has a plastic material on each face thereof and is wider than said liner panel to provide an edge portion along each edge of said liner panel, whereby said edge portions of adjacent panel units are adapted to be overlapped and heat-sealed.

4. A panel unit according to claim 3, wherein said thermal liner panel includes a fabric layer having a plastic coating of light color on the surface facing away from said first panel.

5. A panel unit according to claim 2, wherein said thermal liner panel includes a fabric layer, and plastic strips sewn to the inner surface of the liner panel to provide said edge strips.

6. A panel unit according to claim 1 wherein said thermal liner panel also has an opening at at least one end thereof.

* * * * *